United States Patent [19]

Payne et al.

[11] 4,291,640

[45] Sep. 29, 1981

[54] POWDER COATING APPARATUS FOR TWO-PIECE CANS

[75] Inventors: Robert D. Payne, Countryside; Thomas F. Jordan, Oak Park, both of Ill.

[73] Assignee: The Continental Group, Inc., New York, N.Y.

[21] Appl. No.: 831,977

[22] Filed: Sep. 9, 1977

[51] Int. Cl.[3] ..... C23C 13/08; B05B 7/00; B05B 1/28

[52] U.S. Cl. ..... 118/50.1; 118/50; 118/308; 118/312; 118/318; 118/326; 118/620; 427/28; 427/105; 427/106; 427/181; 427/183; 427/233

[58] Field of Search ..... 118/50, 50.1, 308, 312, 118/318, 326, 620; 427/28, 105, 106, 181, 183, 232, 233, 620

[56] References Cited

U.S. PATENT DOCUMENTS

| | | | |
|---|---|---|---|
| 1,816,903 | 8/1931 | Hageman et al. | 427/106 |
| 2,094,242 | 9/1937 | Parker | 427/181 X |
| 3,323,489 | 6/1967 | Gustin | 118/49.1 |
| 3,735,727 | 5/1973 | Sussmann | 118/48 |
| 3,874,595 | 4/1975 | Rindisbacher | 239/102 X |
| 4,025,660 | 5/1977 | Crose et al. | 427/28 |
| 4,025,664 | 5/1977 | Gerek et al. | 427/183 |

FOREIGN PATENT DOCUMENTS

| | | | |
|---|---|---|---|
| 499666 | 6/1930 | Fed. Rep. of Germany | 118/312 |
| 729469 | 12/1972 | Fed. Rep. of Germany | 118/306 |
| 2055930 | 5/1971 | France | 118/312 |

*Primary Examiner*—Shrive P. Beck
*Attorney, Agent, or Firm*—Charles E. Brown

[57] ABSTRACT

An apparatus for the internal coating of a two-piece can body with a powder. Two-piece can bodies include a body and an end. A stream of powder is directed towards the corner between the end and the body in a circular path by rotating either the can body or the powder dispenser so as to coat the end of the can body. A recovery tube is provided to draw the powder rearwardly out of the can body away from the end in a generally cylindrical path adjacent the interior wall of the body so as to coat the body with the powder. The powder is electrostatically charged so as to adhere to the can body until such time as the powder may be suitably cured.

9 Claims, 3 Drawing Figures

POWDER COATING APPARATUS FOR TWO-PIECE CANS

This invention relates in general to new and useful improvements in the coating of the interior of can bodies, and more particularly to the powder coating of two-piece can bodies.

Commercial two-piece can bodies, which are drawn and wall ironed into a cylindrical shape with one end closed, require protective interior coating which performs several functions. The coating prevents corrosion of the can metal by the product as well as migration into the product of metal ions which may affect the product's flavor or appearance.

Use of two-piece cans is currently most concentrated in the beverage market, where sustained runs of a single-label can justifies the capital expense of a two-piece can body production line. Aluminum was the metal material initially used in two-piece can production. Its use was encouraged because of the relative ease of forming and its intrinsic avoidance of a problem of ion exposure to the product. For instance, the flavor and appearance of beer is tolerant of much higher aluminum ion concentrations (a factor of ten or more) than of iron ion concentrations.

Strong economic considerations have encouraged a change to steel as the two-piece can body material. Can manufacturers have evaluated tin-plate, tin-free-steel, black-plate and polymer pre-coated black-plate. In each case, the steel two-piece can body has ultimately required a high quality, virtually pin-hole-free interior protective coating in order to avoid the ion pick-up by the product and to avoid pin-hole perforation of the can body by acid beverage products.

The two-piece can body which currently requires the most interior protection is the tin-plate soft drink container. In commercial production, this can body can presently require two inside lacquer spray operations along with two oven bake operations. This double coating, which requires duplication of expensive capital equipment, is necessary because sufficient liquid spray material cannot be uniformly applied in one pass. When coating in one pass has been attempted, draping, running and sagging occurs. The heavy interior coating (ultimately 400–500 mg.) found to be necessary to avoid pin-hole perforations during storage of 12 oz. soft drink cans.

It has been found that dry electrostatic powder coating technology is capable of applying a much wider range of coating weights in a single pass than prior liquid systems. A single-pass coating of 500 mg. per 12 oz. can body is well within the operating range of a powder application system. This has already been demonstrated with respect to three-piece can bodies. The potential capital savings of a one-pass powder coating system for a two-piece soft drink can over the present commercial two-pass liquid system, makes the one-pass powder coating system highly desirable.

In accordance with this invention, there is provided a one-pass powder coating system which utilizes an applicator which includes a supply tube which dispenses a powder-air admixture stream which has been electrostatically charged. The supply tube sprays a powder-air admixture into the can body in a generally annular path into the corner or chime area with the path being such that the entire inner surface of the end is coated.

In accordance with this invention, the supply tube may be stationary and the can body rotated or, alternatively, the can body may be stationary and the discharge end of the supply tube moved in an annular path.

Further, in accordance with this invention, there is associated with the supply tube a recovery tube. The recovery tube has a vacuum drawn therein and in cooperation with the spraying of the powder-air admixture stream into the can body, the recovery tube causes a shaping of the powder not adhering to the end into a cylindrical path adjacent the interior surface of the body so as to present the powder to the body for electrostatically bonding thereto.

In accordance with this invention, the powder is charged by a corona charging electrode which is carried by the supply tube. The charged powder is deposited within the interior of the can by the process of mutual repulsion and self-reciprocation. The so-called "Faraday Cage" effect, which one might expect to inhibit electrostatic deposition within the confined chime area, is not applicable in the coating arrangement of this invention because of the physical distance between the corona electrode and the chime area. Faraday fieldlines from the corona electrode terminate on the body wall only a short distance inside of the can body.

With the above, and other objects in view that will hereinafter appear, the nature of the invention will be more clearly understood by reference to the following detailed description, the appended claims and the several views illustrated in the accompanying drawings.

IN THE DRAWINGS

Figure 1:
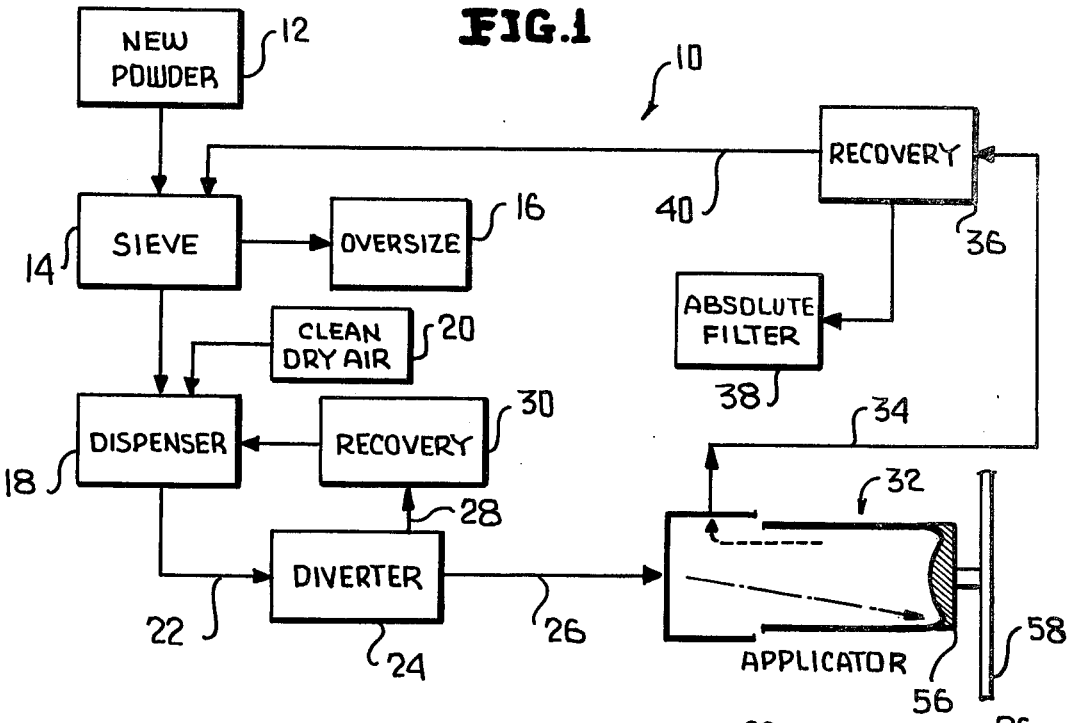
FIG. 1 is a schematic showing of the flow diagram of the powder coating system of this invention.

Referring now to the drawings, it will be seen that there is schematically illustrated in FIG. 1 a powder coating system for can bodies which is generally identified by the numeral 10. The system 10 includes a powder supply 12 which directs powder into a sieve 14 for the purpose of making certain that only certain size powder particles are supplied. Oversize powder particles are directed to a container 16.

Powder particles passing the sieve 14 are directed into a powder dispenser 18 together with clean dry air from a source 20 and the powder-air mixture is directed from the dispneser 18 through a delivery line 22 to a diverter 24. The diverter 24 is contructed to quickly switch the powder-air admixture stream between a delivery line 26 and a recovery line 28 with the recovery line 28 being directed into a recovery chamber 30 which, in turn, is connected to the dispenser 18 for recycling the powder-air admixture. The diverter may be of any conventional construction and a suitable construction is found in U.S. Pat. No. 3,901,184 to Robert D. Payne et al.

The delivery line 26 is connected to an applicator generally identified by the numeral 32. There is also connected to the applicator 32 a recovery line 34 which is connected to a recovery device 36. The recovery device 36 supplies a suction to the recovery line 34 to draw excess powder from the applicator 32. Air is drawn from the recovery device 36 through a filter 38 and recovered powder is directed back into the sieve 14 through a powder line 40.

Figure 2:
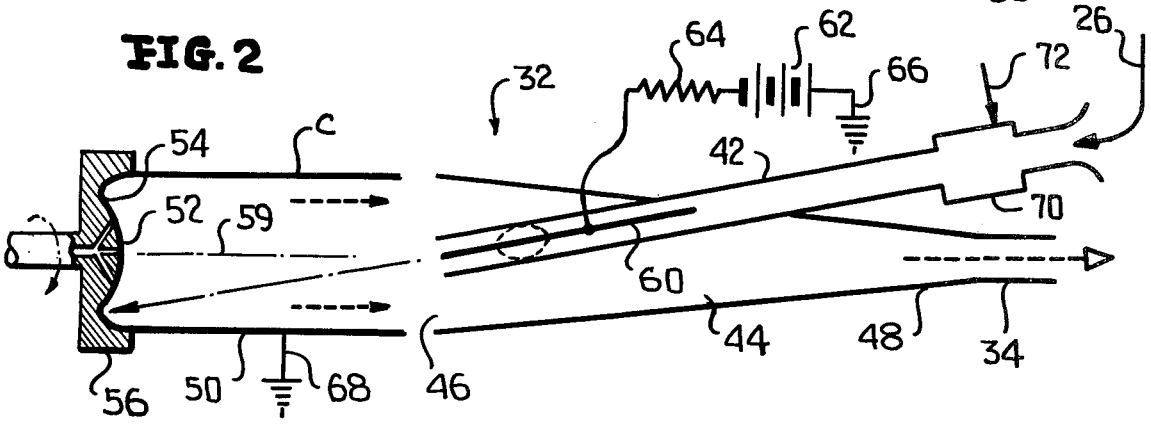
FIG. 2 is a schematic sectional view taken through one form of applicator in accordance with this invention.

Referring now to FIG. 2, it will be seen that there is illustrated one of the two forms of applicators developed in accordance with this invention. The applicator 32 includes a supply tube 42 and a recovery tube 44. The recovery tube 44 is of a generally conical configuration and has an entrance mouth 46 and a discharge end 48, the discharge end 48 being connected to the recovery line 44. The diameter of the mouth 46 corresponds to the internal diameter of a can body C which is to be coated with powder.

At this time it is pointed out that the can body C is a two-piece drawn wall-ironed can body and includes a body portion 50 having an integral end 52. The end 52 is joined to the body 50 at an annular corner or chime 54.

In the embodiment of the applicator 52, the can body C is mounted for rotation and the supply tube 42 is fixed. Accordingly, the can body C is presented to the applicator 32 by means of a holder 56 which is suitably rotated. The illustrated holder utilizes a vacuum source to hold the can body C in place. However, it is to be understood that any type of holder may be utilized. Also, as is best illustrated in FIG. 1, the holder 56 may be one of a plurality of holders carried by a turret 58. Inasmuch as the manner in which the can body is supported and rotated is not a specific part of this invention and since conventional prior equipment may be utilized, no attempt is made here to more specifically illustrate or describe the holder construction.

Returning now to the supply tube 42, it is to be noted that it is of a smaller diameter than the mouth 46 of the recovery tube 44. The supply tube 42 extends through a wall of the recovery tube 44 and is fixedly positioned in angular relation to an axis 59 of a can body C.

The supply tube 42 has in the end portion thereof adjacent the exit end a corona electrode 60 connected to a high voltage, direct current power supply 62 through a large current limiting resistor 64. The power supply 62 is grounded as at 66. Means are also provided for grounding a can body being coated as at 68.

The supply tube 42 is connected to the delivery line 26 for receiving the pneumatic power flow therefrom and clean dry air is added thereto in a mixture 70 through an air supply line 72. The powder particles of the powder-air admixture stream passing through the supply tube 42 are electrostatically charged such that they will bond to the interior of the can body C when applied.

It will be seen from FIG. 2 that the center of the powder-air admixture stream from the supply tube 42 is directed into the corner or chime area 54 of the can body C. It is to be understood that the powder pattern will be such that the entire end 52 will be coated, together with at least a portion of the interior of the body portion 50 of the can body C. Then as the powder is drawn from the can body C by the suction within the recovery tube 44, it returns in a generally cylindrical pattern so as to coat the interior surface of the body portion throughout the length thereof.

Figure 3:
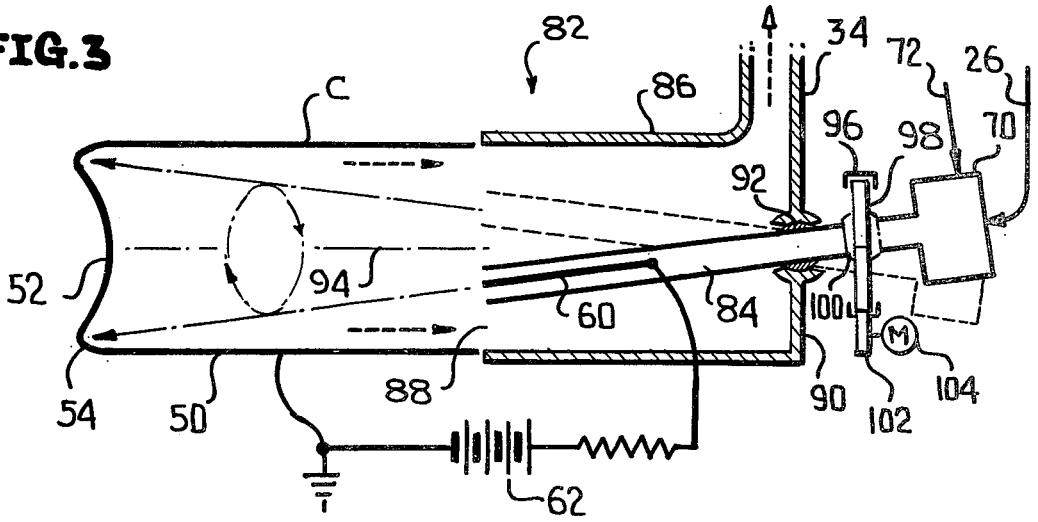
FIG. 3 is another schematic sectional view taken through a modified form of the applicator.

Reference is now made to FIG. 3 wherein a slightly modified form of applicator is illustrated. The applicator is generally identified by the numeral 82 and includes a supply tube 84 and a recovery tube 86. In this embodiment, the recovery tube 86 is generally cylindrical and has the recovery line 34 coupled to the sidewall thereof adjacent the end remote from the mouth 88. The opposite end of the recovery tube 86 is closed by an end wall 90.

It is to be noted that the supply tube 84 extends through the end wall 90 and is mounted for oscillatory movement relative to the wall 90 by means of a spherical bearing 92. It is to be understood that the can body C to be coated is stationary and the supply tube 84 is rotated about the axis 94 of the can body. The net result of the holding of the can body C stationary and the rotation of a supply tube 84 in the illustrated manner is the equivalent of holding the supply tube in a fixed angular position with respect to the can body axis rotating the can body in the manner shown in FIG. 2.

It is to be understood that the supply tube 84 may be rotated about the axis 94 in any desired manner. However, for illustrative purposes, there is provided a track 96 in which there is rotatably mounted a drive wheel 98. The drive wheel 98 is provided with a spherical bushing 100 through which the supply tube 84 extends. It is to be understood that the spherical bushing is disposed off center of the center of rotation of the drive wheel 98 to provide for the necessary rotation of the supply tube 84 about the axis 94 in angular relation thereof. The drive wheel 98 is driven by friction drive member 102 coupled to a suitable motor 104.

It is to be understood that other than its mounting, the supply tube 84 is identical to the supply tube 42 and includes a corona electrode 60 coupled to the power supply 62 through the resistor 64 and that both the power supply 62 and the can body C are grounded.

It is to be understood that the supply tube 84 is provided with a mixing chamber 70 to which there is connected both the delivery line 26 and the air supply line 72.

OPERATION

The operation of the two apparatus 32 and 82 is identical. When a can body C is positioned relative to the apparatus, the diverter 24 serves to divert the powder supply into the delivery line 26 to the applicator. The powder particles are charged by the corona electrode 60 and are directed against the interior of the can body C where they adhere due to the electrostatic charge. Once sufficient coating time has been provided, the diverter 24 is actuated to divert the powder supply to the recovery device 30 and the coated can body C is removed and another can body C is positioned relative to the apparatus. Coated can body C is directed to a curing source for effecting the melting and bonding of the powder particles to form an overall integral coating.

It is to be understood that because only a finite coating time is available, there will always be some of the powder which is insufficiently charged for deposition within the can. Undeposited powder is collected by the recovery tube or shroud 44, 86 and pneumatically conveyed to the recovery unit. Powder from this recovery unit is sieved to remove agglomerates and contaminents and then mixed with incoming new powder. This allows 99% utilization of coating power added to the powder coating system.

It is to be understood that the size of the recovery tube or shroud is matched to the size of the can body being coated. Powder is prevented from escaping through the small gap and the recovery tube at the open end of the can body by the negative pneumatic pressure of the recovery system.

It is also to be understood that exclusive of the corona electrode, all parts of the applicator are constructed of dielectric materials to minimize its capacitance. This precaution, along with the use of the current limiting resistor 64 prevents the accumulation of sufficient energy to ignite the powder-air admixture within the applicator.

At this time it is pointed out that although the can body C may be fixed when associated with the coating apparatus 82, the can body may also be beneficially rotated in the manner illustrated in FIG. 2.

Although only two preferred embodiments of the invention have been specifically illustrated and described herein, it is to be understood that minor variations may be made in the powder coating apparatus without departing from the spirit and the scope of the invention as defined by the appended claims.

What is claimed as new is:

1. Apparatus for internally powder coating a closed end tubular member having an internal corner defined by an intersection of a body with an end and an axis, said apparatus comprising an elongated supply tube for supplying powder in a controlled stream and at an angle to the axis of the tubular member in the area of internal corner of the tubular member, means for effecting relative rotation of said supply tube and the tubular member generally about an axis of the tubular member to deposit powder to the corner and end of the tubular member in an annular pattern, supply means connected to said supply tube for delivering a powder stream to said supply tube, and fixed recovery means for withdrawing powder from the tubular member along the interior surface of the body of the tubular member to effect coating of the interior surface of the body by returning powder, said recovery means including a recovery tube having an open end of an internal diameter substantially corresponding to the internal diameter of the intended tubular member, said recovery tube having a wall and said supply tube extending through said wall, said supply tube terminating within said recovery tube and being small in cross section as compared to the open end of said recovery tube, and a suction source connected to said recovery tube.

2. Apparatus according to claim 1 wherein said tube is stationary and there are means for rotating the tubular member being coated.

3. Apparatus according to claim 1 wherein there are means for rotating said supply tube in a conical path about said axis.

4. Apparatus according to claim 1 together with a corona electrode extending axially within said supply tube.

5. Apparatus according to claim 3 wherein said recovery tube wall is an end wall remote from said open end, and said end wall carries a spherical bearing supporting said supply tube for rotation in said conical path.

6. Apparatus according to claim 5 wherein said suction source is connected to said recovery tube adjacent said end wall.

7. Apparatus according to claim 1 wherein said recovery tube is generally conical and said wall of said recovery tube through which said supply tube extends is generally conical.

8. Apparatus according to claim 7 wherein said suction source is connected to said generally conical recovery tube at an end thereof remote from said open end.

9. Apparatus according to claim 7 wherein said recovery tube has an axis, and rotating means spaced from and aligned with said recovery tube for rotating a tubular member about the axis of the tubular member with the tubular member axis being aligned with said recovery tube axis.

* * * * *